United States Patent [19]

Kohler

[11] Patent Number: 4,736,777

[45] Date of Patent: Apr. 12, 1988

[54] RAPIER FOR A SHUTTLELESS LOOM

[75] Inventor: Lothar Kohler, Tann-Ruti, Switzerland

[73] Assignee: Sulzer Brothers Ltd., Winterthur, Switzerland

[21] Appl. No.: 11,108

[22] Filed: Feb. 5, 1987

[30] Foreign Application Priority Data

Feb. 13, 1986 [CH] Switzerland ..... 00670/86

[51] Int. Cl.[4] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 4,371,008 | 2/1983 | Freisler | 139/448 |
| 4,417,606 | 11/1983 | Corain | 139/448 |
| 4,520,851 | 6/1985 | Rohr et al. | 139/448 |

*Primary Examiner*—Henry S. Jaudon

*Attorney, Agent, or Firm*—Kenyon & Kenyon

[57] ABSTRACT

The rapier is constructed so that the tongue is guided at one end by an articulated connection to the actuating lever and at the opposite end in the hook. Guide surfaces for the tongue in the casing are eliminated. A compression spring biases the tongue into the hook and a second spring biases the tongue tip against one flank of the hook.

9 Claims, 4 Drawing Sheets

RAPIER FOR A SHUTTLELESS LOOM

This invention relates to a rapier for a shuttleless loom.

As is known, looms of the shuttleless type frequently employ a rapier for the picking of a weft yarn across the width of the loom. Generally, such a rapier is constructed of a grip hook which extends from a casing and an associated grip tongue which is movable by means of a spring force longitudinally of the grip hook.

Further, the head of the tongue is usually provided with a gripping surface which is disposed opposite a gripping flank of the hook which is inclined to the direction of rapier movement in order to retain a weft yarn therebetween during picking. As described in U.S. Pat. No. 4,717,606 and German O.S. No. 3136615, it has been known to have one end of the rapier grip tongue pivoted to a bent lever via a link so that when the lever is actuated, the tongue moves in a longitudinal guide in the rapier. Also, when the bent lever is not acted upon by any external force, the tongue is pivoted by a spring strip so that the tongue is pressed into a wedge-shaped recess in the hook. Similar constructions are also disclosed in other publications, such as U.S. Pat. No. 4,520,851.

In both of the above noted publications, rectilinear guides are provided for a stem of the tongue and are disposed in the rapier casing. However, one disadvantage of such a construction is that the guide surfaces of the guides must be disposed in the rapier casing. Further, these guide surfaces as well as the tongue stem must have a surface structure suitable for guiding. However, these requierments greatly limit rapier construction and choice of material and lead to elaborate and material intensive constructions.

Accordingly, it is an object of the invention to provide a rapier of reduced weight.

It is another object of the invention to reduce the number of guide surfaces in a rapier for guiding a grip tongue.

It is another object of the invention to provide a rapier of relatively simple construction.

It is another object of the invention to provide an inexpensive rapier which is capable of high speed operation.

Briefly, the invention provides a rapier for a shuttleless loom which is comprised of a casing, a grip hook which extends from the casing, a grip tongue which is movably mounted in the casing and which has a tip for engaging within the hook to grip a weft yarn therebetween, a tongue actuating lever which extends from the casing and an articulated connection connecting the lever to the tongue. The construction of the rapier is such that the tongue is guided by the articulated connection and by way of the tongue tip. Thus, there is no need of tongue guiding surfaces in the casing so that the casing and the tongue stem can be very simple and light weight in construction. As a result, the rapier can be made at a relative minimum of cost while at the same time being capable of picking weft yarns at high rates.

These and other objects and advantages of the invention will become more apparent from the following detailed description taken in conjunction with the accompanying drawings wherein:

FIG. 10 illustrates a further modified cross-sectional view of a means for guiding and retaining a tongue in a hook in accordance with the invention.

Figure 1:
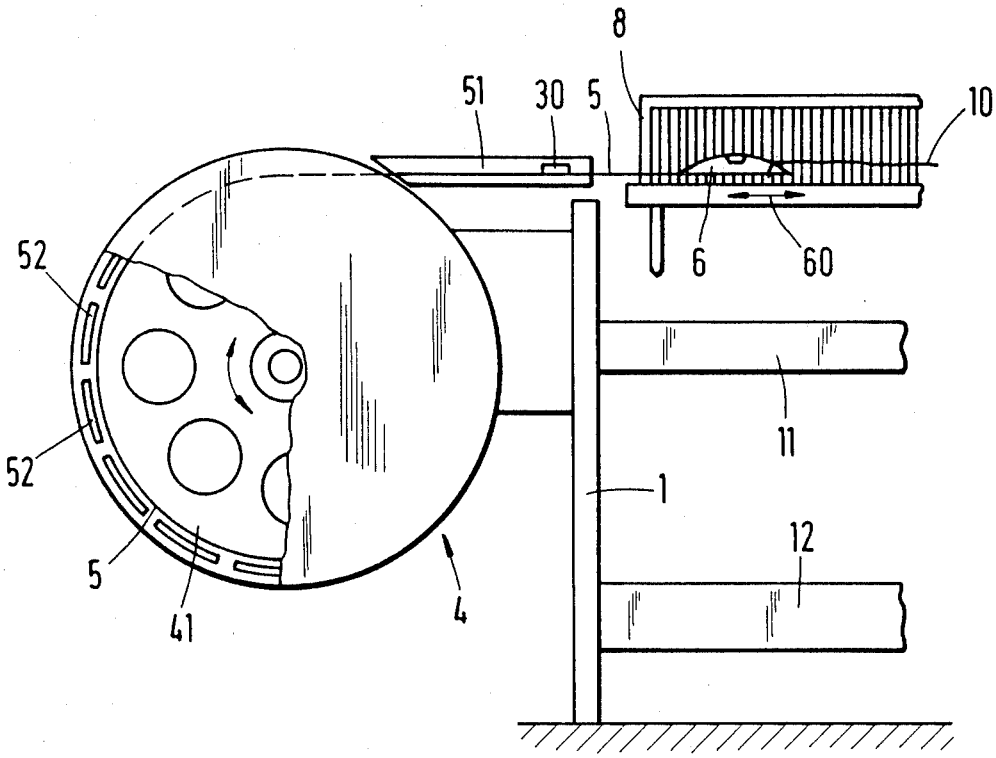
FIG. 1 illustrates a view of a part of a shuttleless loom having a rapier drive.

Referring to FIG. 1, a shuttleless loom frame 1 is provided with a rapier drive transmission 4 as well as central beams or supports 11, 12. As is conventional, a reed 8 is disposed above the beams 11, 12.

The rapier drive transmission 4 includes a driving wheel 41 which acts by way of a drive tape 5 to reciprocate a rapier 6 along the reed 8 in a longitudinal direction as indicated by the double arrow 60.

Figure 2:
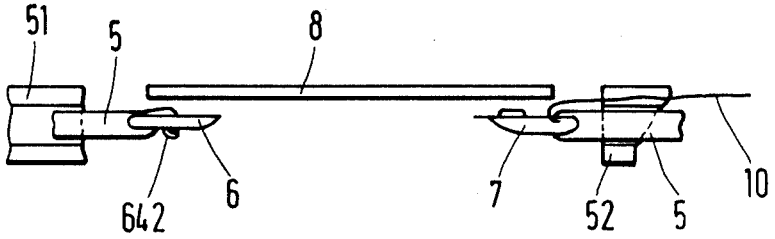
FIG. 2 illustrates a plan view of a part of the shuttleless loom of FIG. 1 to further illustrate the rapier drive.

As indicated in FIG. 2, during operation, a weft yarn 10 is picked from right to left, as viewed, by a weft carrying rapier 7 which is also driven by a flexible tape 5 with a rapier 7 picking the yarn 10 to the left as far as the center of the reed 8. Thereafter, the take-up rapier 6 takes the yarn 10 and completes picking. At the end of picking, a lever arm 642 which projects from the rapier 6 strikes a cam 30 within the transmission 4 so that the rapier 6 releases the picked yarn.

As indicated in FIG. 2, each of the rapier tapes 5 is guided on the loom frame by respective guides 51, 52.

Figure 3:
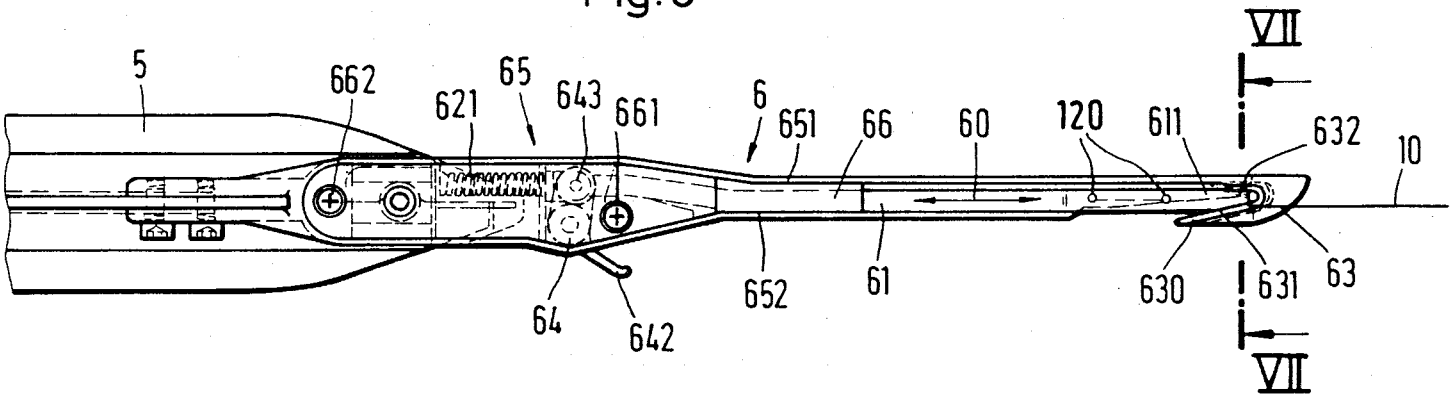
FIG. 3 illustrates a side view of a rapier constructed in accordance with the invention.
Figure 4:
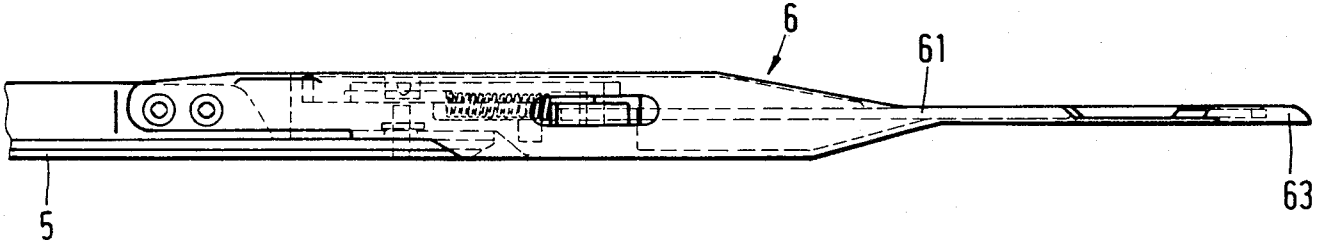
FIG. 4 illustrates an inverted plan view of the rapier of FIG. 3.

Referring to FIGS. 3 and 4, the take-up rapier 6 is secured to the tape 5 and basically comprises a casing 65 having side walls 651, 652. In addition, a grip hook 63 extends from the casing 65 for engaging the weft yarn 10. In this regard, the hook 63 has an insert 630 disposed therein. This insert 630 has a pair of angularly disposed opposed flanks 631,632.

The rapier 6 also has a grip tongue 61 disposed between the sides walls 651, 652 and which extends into the hook 63. In this respect, the grip tongue 61 has a tip 611 which is of wedge-shape so as to be slidably received within the insert 630 of the grip hook 63. The casing 65 is also provided with a cover 66 which is secured thereon by screws 661, 662 in order to protect the tongue 61. As indicated in FIG. 3, during picking a yarn 10 is retained between the grip hook 63 and the tip 611 of the tongue 61.

Figure 6:
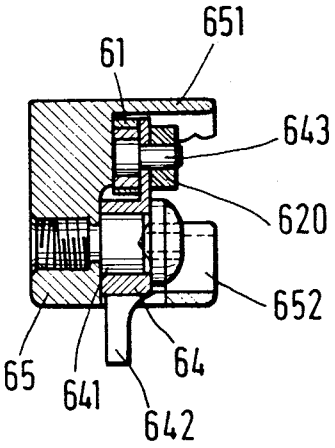
FIG. 6 illustrates a view taken on line VI—VI of FIG. 5.
Figure 5:
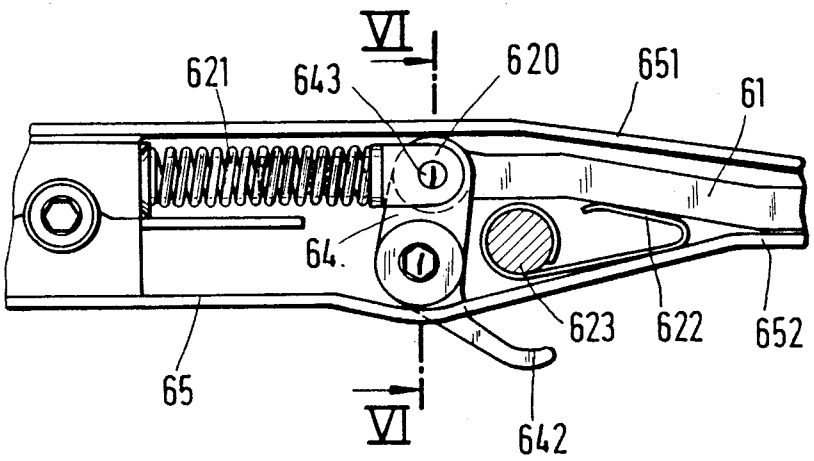
FIG. 5 illustrates an enlarged view of a part of the rapier of FIG. 3.

Referring to FIGS. 5 and 6, a lever 64 is pivotally mounted on a pivot pin 641 within the casing 65 as to be freely rotatable relative to the casing. This lever 64 carries the lever arm 642 which engages the cam 30 (see FIG. 1) in order to actuate the tongue 61. In addition, the lever 64 is connected to the tongue 61 via an articulated connection, for example, a pin 643 which is common to the lever 64 and the stem end of the tongue 61. A spring 621 is also disposed between a link 620 pivotally mounted on the common pin 643 and a stationary part of the casing 65 to bias the lever 64 in a clockwise direction, as viewed in FIG. 5, in order to move the tongue 61 into engagement with the hook 63. In addition, a hairpin spring 622 is mounted on a pivot 623 within the casing 65 and is disposed below the tongue 61 so as to bias the tongue 61 in a counterclockwise direction about the pin 643.

The grip tongue 61 is thus unsupported within the case 65, i.e. is not guided by any guide surfaces in the casing 65, between the tip 611 and the articulated connection.

In use, when the take-up rapier 6 is moved to the left, the end of the lever 642 is pivoted via the cam 30 in a counterclockwise direction. Thus, the tongue 61 is moved away from the hook 63 so that the weft yarn 10 is released. During this movement, which is indicated by the double arrow 60 in FIGS. 1 and 3, the tongue 61 slides over the end of the hairpin spring 622. Consequently, the tongue 61 is pivoted on the pin 643 in a counterclockwise manner, as viewed. After the rapier 6 begins a right hand movement, as viewed in FIGS. 1 and 2, the lever 64 disengages from the cam 30 so that the spring 621 moves the tongue 61 to the right and into engagement with the hook 63. The tip 611 of the tongue 61 is then pressed into the insert 630 in the hook 63.

Figure 7:
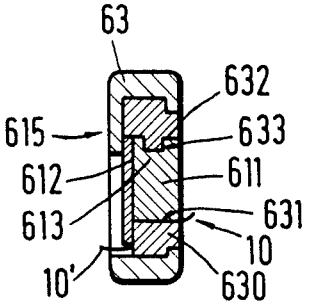
FIG. 7 illustrates a view taken on line VII—VII of FIG. 3.

Referring to FIGS. 3 and 7, the rapier is also provided with a means for guiding and retaining the tongue 61 in the hook 63. In this respect, the means guides the tongue tip 611 longitudinally within the insert 630 of the hook 63 in order to prevent transverse movement of the tongue tip 611 relative to the hook 63. As indicated in FIG. 7, this positive guide means includes a groove 613 which is formed in an upper surface of the tongue tip 611 and a projection 633 which is formed on the insert flank 632 to be matingly received within the groove 613. The horizontal clearance between the grooves 613 and the projection 633 is very reduced in order to obviate horizontal relative movement between the tongue tip 611 and the insert 630. As indicated, the lower surface of the tongue tip 631 bears on the flanks 631 of the insert 630 in order to grip a weft yarn 10 therebetween.

When the tongue tip 611 is in the position illustrated in FIG. 7, the compression spring 621 presses the tongue tip 611 onto the lower insert flank 631 with both flanks 631, 632 taking up the pressure of the spring 621.

A clamping plate 612 is also secured to the tongue tip 611 and has an upper edge disposed between the hook 63 and the tongue tip 611. As shown in FIG. 7, the lower edge of the clamping plate 612 extends below the tongue tip 611 and engages along the flank 631 of the insert 630 so that the weft yarn end is deflected inwardly and, therefore, retained more reliably than in the absence of the clamping plate 612.

As indicated in FIG. 3, the tongue tip 611 has a wedge-shaped end to fit into the insert 630. When the tongue 61 is withdrawn from the hook 63 due to pivoting of the lever 64 on the cam 30, the hairpin spring 622 (see FIG. 5) presses the tongue tip 611 onto the upper flank 632 of the insert 630. Since the flanks 61, 632 are both inclined to the direction of movement of the tongue 61 as indicated by the double arrow 60, after a short movement, a gap arises between the tongue tip 611 and the lower flank 631 so that the yarn 10 can slide off the hook 63 through the gap.

Since the spring 622 acts on the tongue 611 at an angle to the longitudinal axis of the rapier, the spring has a first component of spring force operative lengthwise of the rapier, as indicated by the double arrow 60, to boost the effect of the compression spring 621 in the return movement of the tongue tip 611 into the hook 63, while a second component of spring force acting transverse to the longitudinal axis of the rapier, disengages the tongue tip 611 from the hook flank 631 in the open position.

Figure 8:
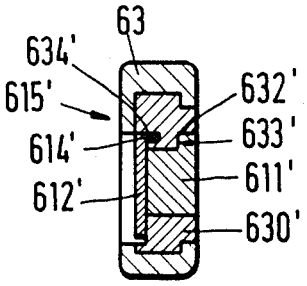
FIG. 8 illustrates a view similar to FIG. 7 with a modified means for guiding and retaining the tongue tip in an insert of the guide hook in accordance with the invention.

Referring to FIG. 8, wherein prime reference charaters indicate like parts as above, the guiding and retaining means may be modified so that the clamping plate 612' has a bent end which is slidably received in a longitudinal groove 634' of the insert 630' such that the tongue tip 611' is positively guided in all directions in the plane of the drawing relative to the insert 630'. In this embodiment, the hairpin spring 622 and the pivot 623 of FIG. 5 can be omitted.

Figure 9:
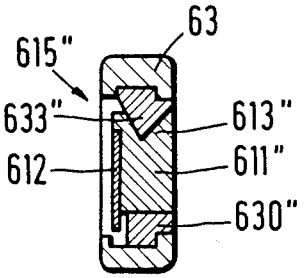
FIG. 9 illustrates a further modified guiding and retaining means in accordance with the invention.

Referring to FIG. 9, wherein double prime reference characters indicate like parts as above, the guiding and retaining means may employ a V-shaped groove 613" in the tongue tip 611" while the flank of the insert 630" has a wedge-shaped projection 633" which is received in the groove without clearance.

As shown in FIGS. 3 and 4, the tongue 61 is guided only at the two ends, and this, by the articulated connection to the lever 64 and by the tongue tip 611. There is no need for guide surfaces within the casing 65 for the tongue 61.

The invention thus provides a rapier of relatively simple light weight construction which can be readily made in a simple manner.

What is claimed is:

1. A rapier for a shuttleless loom comprising
a casing;
a grip hook extending from said casing for engaging a weft yarn;
a spring biased grip tongue disposed in said casing and having a tip for engaging said hook to grip a weft yarn therebetween;
a tongue-actuating lever extending from said casing; and
an articulated connecting connecting said lever to said tongue whereby said tongue is guided by said connection at one end and by said hook at said tip while being unsupported by said casing between said connection and said tip.

2. A rapier as set forth in claim 1 which further comprises a compression spring in said casing biasing said tongue into said hook.

3. A rapier as set forth in claim 2 which further comprises a second spring in said casing having a first component of spring force biasing said tongue towards said hook and a second component of spring force biasing said tongue transversely of a direction of movement into said hook.

4. A rapier as set forth in claim 1 wherein said articulated connection includes a pin connecting a stem end of said tongue to said lever.

5. A rapier for a shuttleless loom comprising
a casing;
a grip hook extending from said casing;
a grip tongue movably mounted in said casing and having a tip for engaging within said hook to grip a weft yarn therebetween;
a tongue acutating lever pivotally mounted in and extending form said casing; and
an articulated connection connecting said lever to said tongue for moving said tongue relative to said hook in response to pivoting of said lever with said tongue unsupported in said casing between said tip and said connection.

6. A rapier as set forth in claim 5 which further comprises a compression spring in said casing biasing said tongue tip into said hook.

7. A rapier as set forth in claim 6 which further a second spring in said casing having a first component of spring force biasing said tongue into said hook and a second component of spring force biasing said tongue transversely of said hook.

8. A rapier for a shuttleless loom comprising a casing;

a grip hook extending from said casing for engaging a weft yarn;

a grip tongue disposed in said casing and having a tip for engaging said hook to grip a weft yarn therebetween;

a compression spring in said casing biasing said tongue into said hook;

a tongue-actuating lever extending from said casing;

an articulated connection connecting said lever to said tongue whereby said tongue is guided by said connection at one end and by said hook at said tip; and a second spring in said casing having a first component of spring force biasing said tongue towards said hook and a second component of spring force biasing said tongue transversely of a direction of movement into said hook.

9. A rapier as set forth in claim 8 wherein said articulated connection includes a pin connecting a stem end of said tongue to said lever.

* * * * *